US010012078B2

(12) United States Patent
Bond et al.

(10) Patent No.: US 10,012,078 B2
(45) Date of Patent: Jul. 3, 2018

(54) METHOD OF APPLYING A THIN SPRAY-ON LINER AND ROBOTIC APPLICATOR THEREFOR

(71) Applicants: Brian J. Bond, Brampton (CA); Abel J. Elias, Brampton (CA); Aaron J. Elliott, Brampton (CA); Seth Galipeau, Brampton (CA); Mark Greaves, Brampton (CA); Stephen M. Kelly, Brampton (CA); Brian W. Richardson, Brampton (CA); Steven F. Simpson, Brampton (CA); Nick McDonald, Brampton (CA)

(72) Inventors: Brian J. Bond, Brampton (CA); Abel J. Elias, Brampton (CA); Aaron J. Elliott, Brampton (CA); Seth Galipeau, Brampton (CA); Mark Greaves, Brampton (CA); Stephen M. Kelly, Brampton (CA); Brian W. Richardson, Brampton (CA); Steven F. Simpson, Brampton (CA); Nick McDonald, Brampton (CA)

(73) Assignee: ABB INC., Brampton (CA)

( * ) Notice: Subject to any disclaimer, the term of this patent is extended or adjusted under 35 U.S.C. 154(b) by 400 days.

(21) Appl. No.: 14/670,527

(22) Filed: Mar. 27, 2015

(65) Prior Publication Data

US 2015/0198041 A1 Jul. 16, 2015

Related U.S. Application Data

(63) Continuation of application No. 13/494,464, filed on Jun. 12, 2012, now abandoned.

(51) Int. Cl.

| | |
|---|---|
| ***B05D 1/02*** | (2006.01) |
| ***E21D 11/38*** | (2006.01) |
| ***E21D 11/10*** | (2006.01) |

(52) U.S. Cl.
CPC ..... *E21D 11/381* (2013.01); *B05D 1/02* (2013.01); *E21D 11/10* (2013.01); *Y10S 901/43* (2013.01)

(58) Field of Classification Search
CPC ..... E21D 11/10; B05D 1/02
(Continued)

(56) References Cited

U.S. PATENT DOCUMENTS

| | | | |
|---|---|---|---|
| 4,613,803 | A | 9/1986 | Hasegawa et al. |
| 5,645,884 | A | 7/1997 | Harlow, Jr. et al. |

(Continued)

FOREIGN PATENT DOCUMENTS

| | | |
|---|---|---|
| DE | 202006008005 | 8/2006 |
| JP | 6-117197 | 4/1994 |

OTHER PUBLICATIONS

Australian Patent Examination Report No. 1, dated Sep. 22, 2016.

*Primary Examiner* — Alexander M Weddle
(74) *Attorney, Agent, or Firm* — Norton Rose Fulbright Canada LLP; Paul J. Field

(57) ABSTRACT

A method and system for applying a liner material to a contoured surface, such as an exposed rock face in an underground hard rock mine, is disclosed. Locations of a plurality of spatially distributed surface grid points on the contoured surface may be detected so as to generate a representative topographical profile of the contoured surface. Based on the plurality of surface grid points, a spray path for a liner application device configured to emit a spray of the liner material may be determined. In some cases, the spray path may have a trajectory that follows the topographical profile of the contoured surface offset therefrom within a spray range of the liner application device. Liner material
(Continued)

may then be sprayed onto the contoured surface while controlling the liner application device to undertake at least one pass of the spray path.

18 Claims, 7 Drawing Sheets

(58) Field of Classification Search
USPC ..... 118/695; 427/8
See application file for complete search history.

(56) References Cited

U.S. PATENT DOCUMENTS

| | | | | |
|---|---|---|---|---|
| 5,851,580 | A * | 12/1998 | Amberg | E21D 11/105 118/317 |
| 7,687,099 | B2 | 3/2010 | Jarvis | |
| 7,767,133 | B2 | 8/2010 | Giloh et al. | |
| 2003/0092848 | A1 * | 5/2003 | Sengupta | B82Y 10/00 525/328.5 |

* cited by examiner

METHOD OF APPLYING A THIN SPRAY-ON LINER AND ROBOTIC APPLICATOR THEREFOR

RELATED APPLICATION

This application is a continuation of U.S. patent application Ser. No. 13/494,464 filed Jun. 12, 2012.

TECHNICAL FIELD

The disclosure relates generally to a robotic applicator for a thin spray-on surface coating or liner and, more particularly, to a method for controlled application of a thin spray-on liner to provide ceiling and wall support in underground, hard rock mines.

BACKGROUND

In underground mining operations, excavated rock wall and ceiling support is commonly employed so as to prevent or reduce the occurrence of rock collapse in excavated areas, such as tunnels, drifts or mine shafts. Rock bolts placed into the rock, generally using mechanical anchors and/or grouts, and positioned at intervals along the excavation may offer a primary form of protection against unplanned rock falls or bursts. Secondary rock wall and ceiling support against smaller rock falls is commonly provided using a combination of a metal wire mesh installed against excavated rock faces with rock bolts and a hardened cementitious material, which is commonly a sprayed concrete such as shotcrete or gunite, to bond to and cover the wire mesh. However, development of thin spray-on liners (TSL's) as a secondary ground support material has begun in recent years. Such TSL's may be formed using a high performance polyurea coating containing a reactive polyurethane or other suitable polymer dispersed into a polymerizable (i.e., capable of undergoing polymerization) diluent.

As ground support materials, combination mesh and shotcrete can exhibit one or more disadvantages or shortcomings. For example, the application of shotcrete onto mesh can be cumbersome and fairly labor intensive, especially in deep mining applications where it can become increasingly more difficult to navigate the large trucks, materials and machinery used for this purpose. Linings produced by combination mesh and shotcrete can also tend to be brittle and lacking in tensile (as opposed to compressive) strength and toughness. Such tensile weakness may render shotcrete-based linings more prone to fracture during mine blasting or other underground operations that cause significant flexing of the underlying rock. This effect may be exacerbated if the wire mesh is not installed flush with an excavated rock face. Additionally, shotcrete may have long dry times to reach full tensile strength of about 1 MPa, which can adversely affect productivity by extending delay times between successive rock blasts while the shotcrete is hardening.

Compared to cementitious ground support materials, such as shotcrete or gunite, TSL's may offer a number of advantages. For example, spray-on liners may offer superior tensile strength (e.g., up to or above 2.5 MPa) with significantly shorter cure times (e.g., as little as 20 seconds) and with thinner resulting material layers. Application of TSL materials to excavated rock surfaces may also be greatly simplified due to reduced material bulk, which may be up to an order of magnitude less volume than shotcrete. Elimination of wire meshing that is commonly used in conjunction with shotcrete or gunite may also confer benefits in its own right, for example, because corrosion of wire meshing is no longer of concern. Handling large sheets of wire mesh is eliminated in confined underground spaces. Further benefits of TSL materials include that its finished surface is usually smoother than shotcrete and therefore less likely to hold mine dust, which may lead to a cleaner and safer working environment. Commonly TSL materials are also manufactured to have a bright colour making the liner highly visible and contributing to a brighter mine environment that can reduce lighting requirements and improve safety conditions.

SUMMARY

In at least one broad aspect, the disclosure relates to a method of applying liner material to a contoured surface. According to the disclosed method, locations of a plurality of surface grid points on the contoured surface may be sensed, with the plurality of surface grid points being spatially distributed so as to provide a representative topographical profile of the contoured surface. Based on the plurality of surface grid points, a spray path for a liner application device configured to emit a spray of the liner material may be determined. Such spray path may have a trajectory that follows the topographical profile of the contoured surface offset therefrom within a spray range of the liner application device. The contoured surface may then be sprayed with the liner material while controlling the liner application device to undertake at least one pass of the spray path.

In at least one other broad aspect, the disclosure relates to a system for applying liner material to a contoured surface. The system may comprise a sensor, a liner application device, and a controller coupled to the sensor and the liner application device. Within the system, the sensor may be configured to locate surface grid points on the contoured surface. The liner application device may be controllable for movement in at least two dimensions and may include a spray nozzle fluidly coupled to a reservoir of the liner material for emitting a spray of the liner material. The controller may include a data processor and device memory on which are stored instructions that are executable by the data processor. When the stored instructions are executed, the controller may be configured to receive sensor data from the sensor representing a plurality of located surface grid points on the contoured surface that are spatially distributed so as to provide a representative topographical profile of the contoured surface. The controller may also thereby be configured to determine a spray path for the liner application device based on the plurality of located surface grid points, with the spray path having a trajectory that follows the topographical profile of the contoured surface offset therefrom within a spray range of the liner application device. The controller may also thereby be configured to control the liner application device so as to spray the contoured surface with a spray of the liner material while undertaking at least one pass of the spray path.

In at least one other broad aspect, the disclosure relates to a non-transitory computer-readable storage medium on which are stored instructions that are executable by one or more data processors. When the stored instructions are executed, the one or more processors may be programmed to perform a method of applying liner material to a contoured surface. According to the method, sensor data may be received from a sensor representing a plurality of located surface grid points on the contoured surface that are spatially distributed so as to provide a representative topographical profile of the contoured surface. A spray path for a liner application device may then be determined based on the plurality of located surface grid points, with the spray path having a trajectory that follows the topographical profile of the contoured surface offset therefrom within a spray range of the liner application device. The liner application device may then be controlled so as to spray the contoured surface with a spray of the liner material while undertaking at least one pass of the spray path.

Further details of these and other aspects of the described embodiments will be apparent from the detailed description below.

BRIEF DESCRIPTION OF THE DRAWINGS

Reference is now made to the accompanying drawings, in which.

DETAILED DESCRIPTION OF THE PREFERRED EMBODIMENTS

Figure 1:
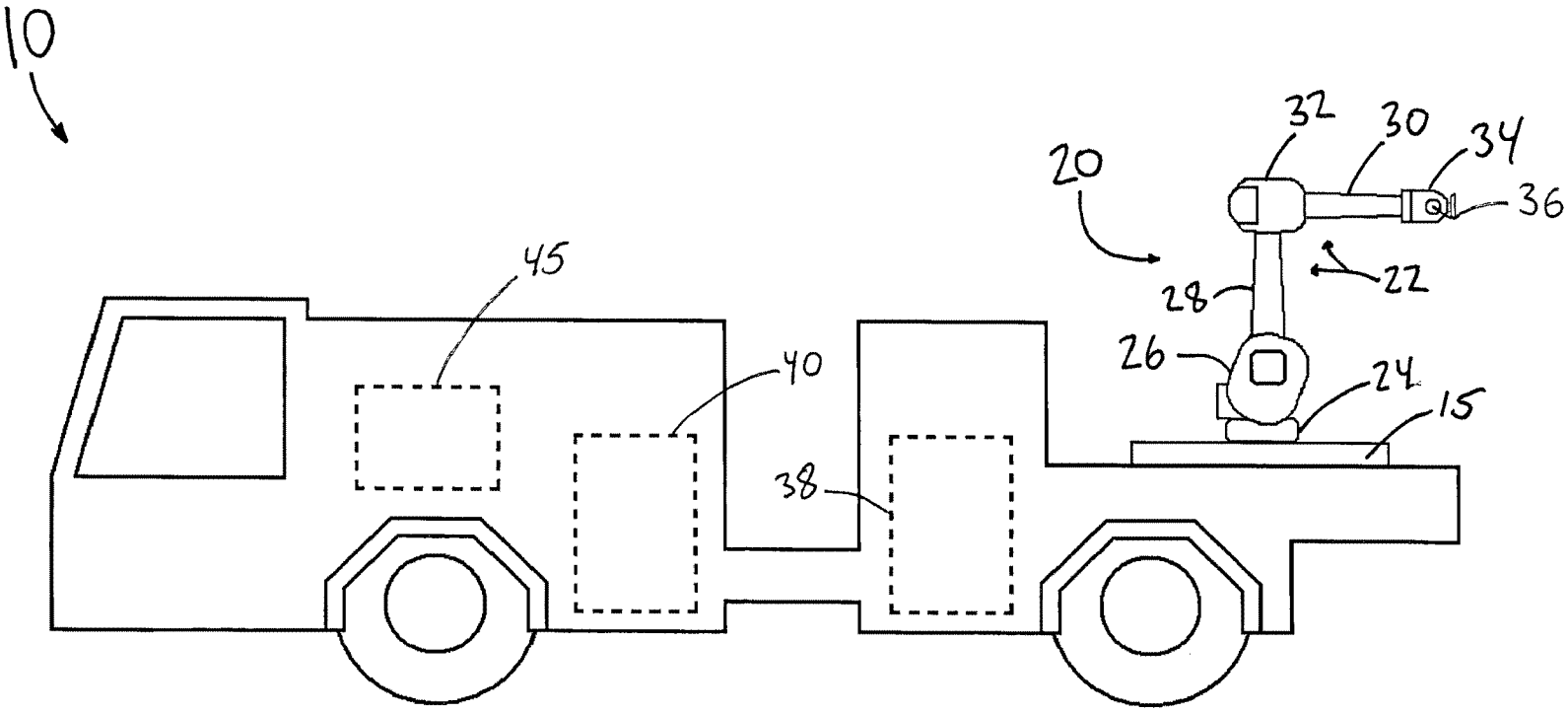
FIG. 1 illustrates a schematic side view of a rubber tired mine truck equipped with a robotic arm configured for application of a thin spray-on liner material.

Various embodiments of the invention, including at least a preferred embodiment, are described below with reference to the drawings. For simplicity and clarity, where appropriate, reference numerals may be repeated to indicate like features in the drawings. In some instances, description of well known features or concepts may be abbreviated or omitted so as to provide a clearer understanding of the described embodiments. It will be understood that the example illustrated in the drawings and described below relates to spraying a tunnel lining in a mine, however many other applications are possible using the same apparatus and methods, such as spraying waterproof coatings inside pipelines, conduits, caissons, troughs, riverbeds, retaining wall structures, rock slopes and cliffs to impede erosion, and fireproofing interior building structures with spray on coatings. Although reference may primarily be made to a thin spray-on liner, the described embodiments may equally be operative for use with other forms of liners and material coatings. Use of the term "liner" herein does not limit the described embodiments only to application of spray on material to interior walls and surfaces and, depending on context, may be intended also to encompass application to exterior walls and surfaces.

Reference is initially made to FIG. 1, which illustrates a rig 10 equipped with a liner application device 20. In the embodiment shown, rig 10 may be a truck or other vehicle capable of transporting liner application device 20 from the surface down underground into a hard rock mine so as to provide access to a drift face (shown in FIG. 3). For example, rig 10 may be a custom designed transport vehicle or a retrofit vehicle made to satisfy at least one specification of a liner application device 20, for example, including a weight or reach requirement. In some embodiments, liner application device 20 may alternatively be self-transported. The benefit of a truck mounted device 20 is that ancillary equipment, such as liquid storage tanks, pumps, hoses, electrical power generators, communication and monitoring equipment etc. can be mounted on the chassis of a rubber tired truck to form a single mobile unit.

In some embodiments, liner application device 20 may comprise a robotic or other controllable arm 22 that is capable of movement in at least two, but more preferably, three free-space dimensions with multiple degrees of freedom. The length of the arm 22 may be varied in different embodiments, but should be long enough to reach all exposed rock faces, for example, when rig 10 is positioned in a generally central position within an excavated mine shaft or tunnel. In some cases, arm 22 may be long enough to reach all exposed surfaces in a typical 5 m×5 m×4 m drift advance while stationary without having to move positions, although longer arm lengths may also be employed for use in conjunction with larger than typical advances (e.g., 8 m long advances.

Arm 22 may be supported on a base 24 that is pivotable in a first plane and a base joint 26 that is pivotable in a second, orthogonal plane. In some cases, base 24 may be pivotable in a generally horizontal (i.e., side-to-side) plane and base joint 26 in a generally vertical (i.e., up-and-down). The combined effect of base 24 and base joint 26 may be to provide arm 22 with capability to be oriented in any arbitrary three-space vector or direction.

In some embodiments, to provide a greater range of movement and controllability in three dimensions, arm 22 may be comprised of two or more jointed portions. For example, as shown in FIG. 1, arm 22 may comprise a lower arm 28 and an upper arm 30 that may be controllable independently or essentially independently of each other. Lower arm 28 may be coupled proximally to base joint 26 and distally to an elbow joint 32. Upper arm 30 may be connected proximally to elbow joint 32 and distally to a head assembly dock 34. As is shown in more detail below in FIG. 2, a head assembly including one or more sensors and/or one or more spray applicators may be detachably secured to head assembly dock 34 using a swivel joint 36, and such head assembly may be used in different embodiments for application of a TSL material to excavated rock faces and other contoured surfaces, e.g., for provision of ground support.

In addition to the two degrees of freedom provided respectively by base 24 and base joint 26, the embodiment of liner application device 20 shown in FIG. 1 may be capable of an additional four degrees of freedom for a total of six degrees of freedom overall. For example, in some embodiments, upper arm 30 may be configured for torsional or rotational movement about its axis. Elbow joint 32 may also be pivotable in a corresponding plane, similar to the pivoting base joint 26 may be capable of. Two more degrees of freedom may be provided by swivel joint 36, including pivoting movement relative to head assembly dock 34 and torsional movement (similar to upper arm 30) about an axis defined by swivel joint 36. As used within the present disclosure, terms such as "degrees of freedom" or "degrees of movement" may be used to indicate unique axes or ranges through liner application device 20 is capable of moving. Thus, in the illustrated embodiment of liner application device 20, each of the base 24, base joint 26, upper arm 30, elbow joint 32, and swivel joint 36 define one (or, in the case of swivel joint 36, two) corresponding unique range(s) of movement forming a constituent part of the overall controllability of arm 22.

Each degree of freedom in arm 22 may define a range of control coordinates through which the corresponding part of arm 22 may be controlled. The overall setting of arm 22 may then be determined as a control vector formed out of the control coordinates from each controllable part of arm 22. For N degrees of freedom, each overall setting of arm 22 may be given by a vector $\overline{S}=(c_1, c_2, \ldots, c_N)$, where each $c_i$, $i=1 \ldots N$ represents the control coordinate for a different degree of freedom within arm 22.

Assuming that arm 22 has full maneuverability in three free-space dimensions using one or more available degrees of freedom, each setting of arm 22 may include both a position and orientation component. For example, arm 22 may be controllable so that a head assembly, or some specific point or location on such head assembly, secured to head assembly dock 34 may be moved into an arbitrary point in space $\overline{P}=(x,y,z)$, defined by corresponding spatial coordinates along three orthogonal axes x, y, z. However, it may also be possible to control arm 22 so that the approach of the head assembly into a given point in space follows an arbitrary trajectory or orientation $\overline{O}=(\theta,\varphi)$, where $\theta$ represents an angle of inclination and $\varphi$ represents an angle in azimuth. As will be appreciated, other coordinate systems may alternatively be employed so as to describe a position and orientation component of arm 22.

With as many as six or more degrees of freedom, arm 22 may be controllable with some inherent redundancy. Such redundancy, alternatively referred to within the present disclosure as a "singularity" or "singularities" in the plural sense, may arise where, for example, more than one control vector of arm 22 maps onto the same position and orientation in free-space. Thus, singularities may arise where there is no one single, unique way of controlling arm 22 to a given position and orientation and it is therefore necessary to arbitrate between different possible coordinate control vectors that would have the equivalent effect of controlling arm 22 to move to the same point in free-space and with the same approach or orientation. As will be explained further below, such control singularities may be detected and resolved in real or near real-time during operation of liner application device 20.

While in some cases the available degrees of freedom through which arm 22 is configured to move may provide liner application device 20 with sufficient reach and maneuverability for an assigned task, additional degrees of freedom that are external to arm 22 may optionally be incorporated into liner application device 20 as well. For example, in some embodiments, liner application device 20 may be mounted on a support structure 15 on rig 10 that is enabled for movement in one or more additional directions to provide further degrees of freedom. However, it is also possible for liner application device 20 to be mounted directly to rig 10 by omission of support structure 15.

As explained further below, in some embodiments, control algorithms for arm 22 may be designed to operate based on a fixed reference point for rig 10. Accordingly, once rig 10 has been positioned and a suitable reference point adopted, it may be convenient when controlling liner application device to keep rig 10 stationary so as to not be required to "re-locate" liner application device 20 within a drift advance. However, the reach of arm 22 alone may not be sufficient to cover all exposed rock faces. The reach of arm 22 may therefore be extended in some cases by provision of additional, "external" ranges of movement. Such additional movement may be effectively utilized to provide arm 22 with sufficient reach to cover all exposed rock surface in a drift advance without having to reposition rig 10 and consequently re-initialize corresponding control algorithms for liner application device 20.

As shown in FIG. 1, support structure 15 may be operative for movement in three free-space directions, namely within a horizontal plane and vertically. For example, support structure 15 may support liner application device 20 on a pair tracks running lengthwise and widthwise along rig 10, respectively, so as to provide movement in two orthogonal directions (i.e., x and y) within a horizontal plane. Movement in a vertical (i.e., z) direction may then be provided by provision of a lift which supports liner application device 20. While this configuration of a support structure 15 provides one possibility, other alternative configurations may be possible as well. For example, it may be possible to provide movement in the horizontal plane using one or more swing pivots or the like, either in replacement of or combination with one or more tracks. One or more external degrees of freedom may also be included in a head assembly (FIG. 2), as explained further below.

Rig 10 may also be equipped with one or more fluid reservoirs containing one or more different types of fluid liner materials for a three-dimensional contoured surface, such as an exposed rock face in an underground mine. In some embodiments, rig 10 may be equipped with reservoirs 38 containing constituent elements for a TSL material, such as a primer, a resin and a hardener as is commonly used in polyureas and other curable copolymers. For example, two reservoirs 38 may be installed on rig 10, one of which contains a quantity of reactive polyurethane or other suitable polymer material, and the other of which containing a polymerizable diluent. A feed hose (not shown) may be used to fluidly couple liner application device 20 to each reservoir (s) 38. In some cases, a mixing valve (not shown) may also be installed on rig 10 so that the liner materials housed in reservoirs 38 may be mixed together en route to or within liner application device 20. Such mixing valve may conveniently, although not necessarily, be located within a head assembly (FIG. 2) of liner application device 20 so that component mixing may occur just prior to emission.

In some embodiments, two further reservoirs 40 may also be installed on rig 10 and used to house raw materials for a base under layer. For example, constituent materials for a foam primer that is applied under a TSL material may be housed in reservoirs 40. In some cases, the base under layer may be a foaming material, such as a suitable polyurea, formed out of two mixed constituents. However, other types of foam underlay that may effectively be applied to wet surfaces (common in underground hard rock mines) are possible as well. A feed hose (not shown) and optional mixing valve (not shown) may also be used to couple reservoirs 40 fluidly with the liner application device 20. Such mixing valve may again conveniently, although not necessarily, be located within a head assembly of arm 22 so that component mixing may occur immediately prior to emission.

In some embodiments, application of a base under layer may be necessary or desirable to provide a more conducive surface for application of TSL material. For example, a quick drying base under layer may be useful for providing a dry layer on which to apply a TSL material. In many underground mining operations, following a round of rock blasting, high pressure water may be used to scale excavated rock surfaces so as to remove loose rocks and other fractured material. Rather than wait for the scaled rock surfaces to dry, a quick drying hydrophilic foam layer or primer may be spray applied and used to prime the rock surfaces for a coating of TSL material thereby improving the bonding of the TSL while filling in smaller recesses in the rock surface to reduce voids or air pockets.

Use of a base under layer may be optional in some embodiments and, if such use is omitted, reservoir(s) 40 for housing base under layer may be re-purposed to house additional quantities of a TSL material instead. Because access to a mine drift may be limited or restricted, providing enough TSL material on rig 10 so as to cover an entire advance (or perhaps more than one) can greatly increase the speed of operations and therefore provide significant cost efficiencies.

A controller 45 may be used to effect robotic or other automated control of liner application device 20 and, in particular, of arm 22 on which a head assembly (FIG. 2) may be installed. For such purpose, controller 45 may include one or more different elements, components or modules using any industrially convenient or expedient technology (ies) and, without limitation, may be implemented using any combination of software component(s), hardware component(s), and/or firmware component(s). In some embodiments, controller 45 may include one or more microprocessors, central processing units (CPU), digital signal processors (DSP), arithmetic logic units (ALU), physics processing units (PPU), general purpose processors (GPP), field-programmable gate arrays (FPGA), application specific integrated circuits (ASIC), or the like, which are all generally referred to herein as "data processor(s)" or simply "processor(s)".

So as to execute one or more different control algorithms or routines stored as program instructions or other code within controller 45, any or each of the above-noted processors may be linked for communication with one or more different computer readable media on which are such program instructions or other code may persistently, even if only temporarily, be stored. Such computer readable media may include program and/or storage memory, including volatile and non-volatile types, such as type(s) of random access memory (RAM), read-only memory (ROM), and flash memory. For greater certainty, in some embodiments, such computer readable media may include any type of non-transitory storage media, although it may be possible in some cases to utilize transmission-type storage media as well.

Any or each of the above-noted processors may also be equipped or configured to operate in association with one or more different logic or processing modules for executing such program instructions or code, as well as other types of on- or off-board functional units. For example, such processors may be coupled to one or more analog to digital converters (ADC), digital to analog converters (DAC), transistor-to-transistor logic (TTL) circuits, or the like, which may be used to interface with one or more peripheral devices, such as sensor(s) and/or actuator(s), which may be included in liner application device 20.

Figure 2:
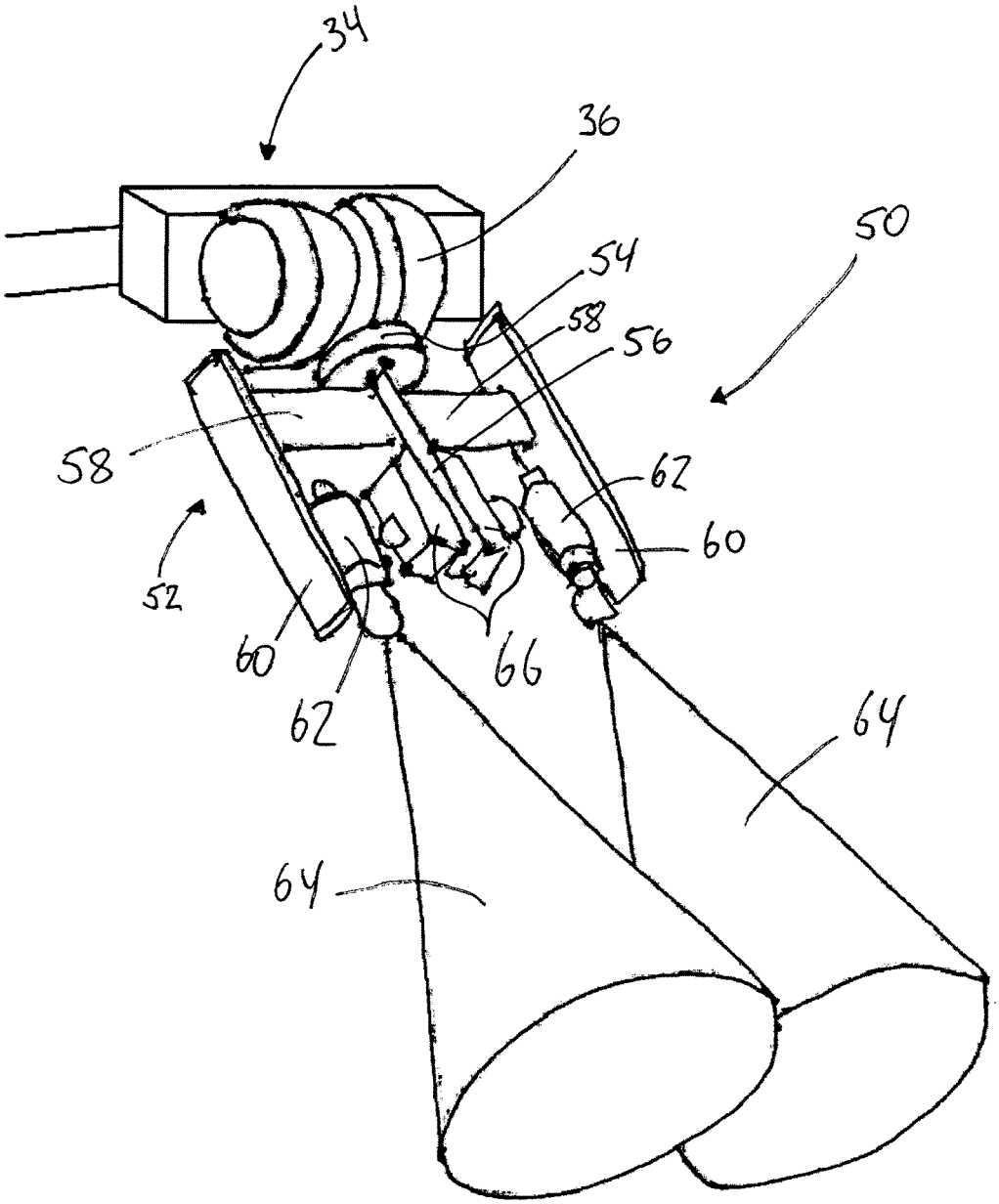
FIG. 2 shows a schematic perspective view of a head assembly for mounting on the robotic arm shown in FIG. 1.

Referring now to FIG. 2, there is shown an embodiment of a head assembly 50 for liner application device 20 shown in FIG. 1. Head assembly 50 may fixedly or detachably secure to head assembly dock 34 of liner application device 20 and, in some embodiments, may generally be operable under the exertion of controller 45 (FIG. 2) to perform both a scanning function and a spraying function. Those familiar with robots will recognize that interchangeable tools or head assemblies are commonly used so that a robot can choose from several different tools from a tool storage tray or carousel where all tools are attachable to a single tool interface on the robot's head assembly dock 34.

As explained in more detail below, according to a scanning function, head assembly 50 may be operable to scan a three-dimensional contoured surface, such as an exposed rock face in an underground hard rock mine, so as to generate a representative topographical profile of the contoured surface. The head assembly 50 may then be operable, according to a spraying function, to deposit a coating of a TSL or other type of material onto the contoured surface following a trajectory that is defined based on and in relation to the representative topographical profile of the contoured surface. Through precise control over the position, orientation and boom speed of the head assembly 50, as well as stand-off distance, TSL material may be sprayed onto the contoured surface in some cases so as to provide a contiguous and/or uniform-thickness coating of a contoured surface In some embodiments, head assembly 50 may include a chassis or frame 52 having an end mount 54 which is securable to swivel joint 36 of the head assembly dock 34. Swivel joint 36 may provide one of the above-noted degrees of freedom of liner application device 20 through pivot movement in a plane, e.g., a generally vertical plane, which contains upper arm 30. As mentioned, a further degree of freedom may be provided through torsional rotation of, i.e., which is translated into rotation of end mount 54. Chassis 52 may be formed into any suitable shape for mounting one or more sensor(s), one or more spray applicator(s), and associated actuator(s) for each active element mounted to chassis 52. For example, chassis 52 may include a spine 56 extending outwardly from end mount 54, and a cross plate 58 joined to the spine 56 proximal to end mount 54. Spaced-apart side arms 60 may be supported on cross plate 58 extending therefrom generally parallel to spine 56. However, it will be appreciated that the configuration of chassis 52 shown in FIG. 2 is exemplary only and that other types, shapes and configurations of a chassis 52 may be possible as well.

A pair of spray applicators 62 may be mounted onto chassis 52, for example, as shown in FIG. 2, at respective distal ends of side arms 60. Each spray applicator 62 may be fluidly coupled to respective reservoir(s) of liner material (TSL or base under layer), such as by way of the above-mentioned feed nose(s), and configured to emit spray(s) 64 of such material. For example, one of the two spray applicators 62 shown may be configured to emit a spray 64 of a TSL material, while the other of the two spray applicators 62 may be configured to emit a spray 64 of a foam primer for a TSL material. In some embodiments, should a foam primer not be required or utilized, one of the spray applicators 62 may be removed from head assembly 50 or otherwise deactivated.

One or more sensors 66 may also be mounted onto chassis 52, for example, as shown in FIG. 2, on laterally opposed edges of spine 56 distally of cross plate 58. Sensor(s) 66 may be any suitably configured sensor or detection device which is capable of determining positions of, or distances, to objects in three-dimensional space. For example, sensor(s) 66 may include configurations of optical sensors, such as lasers or infrared sensor devices, as well as configurations of capacitive, photoelectric, ultrasonic, or any other suitable type of position sensor without limitation. Under the exertion of controller 45, sensor(s) 66 may be capable of detecting surface points on a contoured surface, such as exposed rock faces in underground hard rock mines, from which a representative topographical profile of the contoured surface may be generated.

Such representative topographical profile(s) may be generated by detecting locations of one or more points on the contoured surface in a grid-like formation using sensor(s) 66. Once generated, the representative topographical profile (s) may thereafter be used to control liner application device 20 and, in particular head assembly 50, so that spray nozzle(s) included in spray applicator(s) 62 trace along the contoured surface, in some cases a pre-determined stand-off distance from the contoured surface, and while applying one or more coatings of liner material, such as a TSL material or a foam primer. Further description of processes for applying liner material, locating surface grid points, and determining a spray path to follow during such application is provided below with reference to FIGS. 5-7, respectively.

While the embodiment of head assembly 50 shown in FIG. 2 includes sensor(s) 66 mounted to spine 58 and spray applicators(s) 62 mounted to spaced-apart side arms 60, other configurations of a head assembly 50 may be possible as well in variant embodiments without loss of generality.

In some embodiments, an additional degree of freedom that is external to arm 22 (FIG. 1) may be provided by inclusion of additional components in head assembly 50. For example, a suitably configured rotary actuator may be interposed between swivel joint 36 and end mount 54 so that chassis 52 may be rotated in a generally orthogonal (e.g., horizontal) plane to that through which swivel joint 36 moves. Thereby it may be possible to control the angle of chassis 52 relative to upper arm 30 (FIG. 1), which may advantageously allow greater control over the angle between head assembly 50 and a surface to be coated. For example, it may be required or convenient while coating a contoured surface to maintain a pre-determined angle relative thereto, such as head-on (i.e., 90 degrees) or some other lesser angle.

Figure 3:
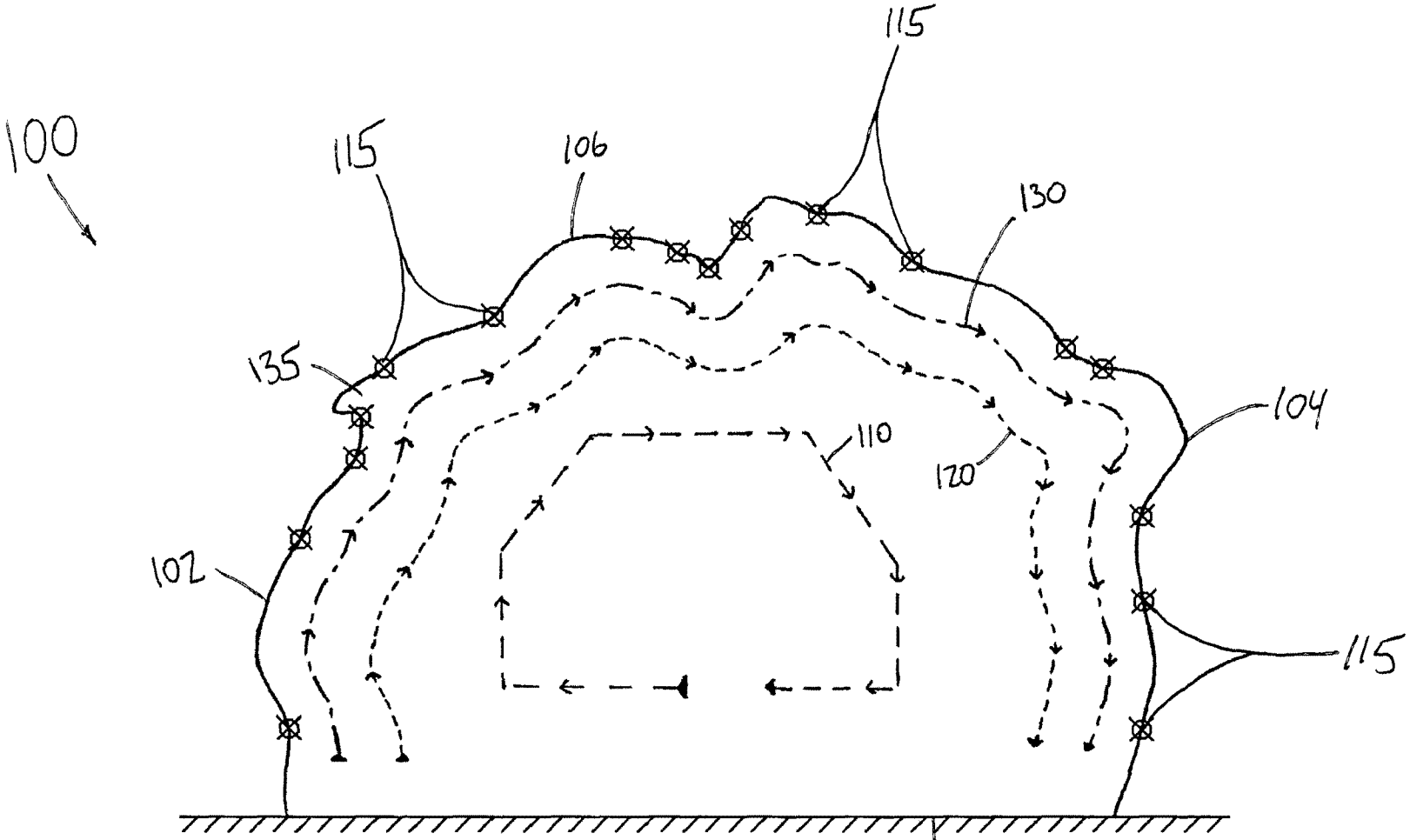
FIG. 3 illustrates survey, scan and spray paths for an excavated shaft or tunnel shown in a transverse sectional view.

Referring now to FIG. 3, there is shown a schematic representation of an advance 100 in an underground mine shaft or drift. Advance 100 may be representative of any three-dimensional space from which rock has been removed within an underground mine, such as but not limited to a mine shaft or drift, which is excavated by drilling, blasting, excavating (mucking) or other mining techniques known in the art. Accordingly, drift 100 may have uneven (i.e., surface-contoured) side walls 102, 104 and top wall 106 (sometimes referred to as the "back" of the drift) that may need to be reinforced against rock bursts and/or falls using one or more forms of ground support, for example, including a coating of a TSL material.

While reference may for convenience be made herein primarily to advance 100, the described embodiments may equally be applicable (either with or without modification or alteration) to other shapes or configurations of contoured surfaces. For example, the described embodiments may also be applicable to "T" or "Y" junctions (sometimes referred to as a "nose" or "nose pillar") within an underground hard rock mine, as well as to safety bays and other recesses or formations cut into side walls 102, 104. The described embodiments may also be applicable to transition areas between horizontal tunnels and vertical shafts.

In some embodiments, it may be necessary or desirable to control application of such a TSL material to side walls 102, 104 and/or top wall 106 of advance 100 in one or more different respects. For example, to increase the efficacy of a TSL material as a ground support material, it may be necessary or desirable to provide one or all of side walls 102, 104 and top wall 106 with a substantially contiguous, i.e., unbroken, coating of TSL material with no substantial expanses of underlying rock face exposed. Portions of side walls 102, 104 and/or top wall 106 that are left uncoated with TSL material (and which therefore expose underlying rock face) may tend to weaken the tensile strength of the entire coating of TSL material and therefore provide less overall effective ground support.

To comply with applicable local safety standards or regulations in the mining industry it may also be necessary to ensure that the coating of TSL material applied to side walls 102,104 and/or top wall 106 provides a minimum tensile strength in resistance to rock bursts and/or falls. Accordingly, in some cases, so as to comply with such minimum tensile strength requirement(s), it may also be necessary to ensure that any coating of TSL material applied to an exposed rock face in advance 100 exhibits at least a required minimum thickness, i.e., which generally correlates to the minimum tensile strength requirement. It may further be necessary to ensure that such minimum thickness is achieved across the whole of a coating of TSL material, again to ensure that no localized weaknesses develop that may tend to weaken the entire coating of TSL material and provide less effective overall ground support.

In some cases and/or for certain types of TSL material, it may even be the case that tensile strength may be affected by provision of too thick a material layer (not just provision of too thin a material layer). For example, certain TSL materials may be more likely to develop small cracks or fissures as layer thickness is increased (e.g., due to increased shear forces within the layer when flexed). Accordingly, it may further be necessary so as to comply with tensile strength requirements to provide a layer of TSL material having a thickness within a pre-determined range defined by both a maximum and minimum thickness.

As described herein throughout, embodiments of the present invention provide a system and method for application of a liner material (e.g., a TSL material) to a contoured surface (e.g., exposed rock faces of an advance 100 excavated in an underground hard rock mine), which may enable precise, accurate, and reproducible control over such application. Such method(s) and system(s) in some cases may involve one or more passes of a sensor (e.g., as included in liner application device 20 shown in FIG. 2) along survey and/or scan paths defined in relation to advance 100 in order to generate representative topographical profile(s) of exposed rock faces. One or more passes of a spray applicator (e.g., as included in liner application device 20) along the contoured surface following a spray path may subsequently be undertaken so as to effect controlled application of liner material thereto, which may be utilized effectively, in at least some cases, for provision of ground support against rock falls.

In some embodiments, scanning of exposed rock faces in advance 100 for the purpose of generating topographical profile(s) may be undertaken in multiple phases or stages. For example, scanning may be undertaken in two separate passes, including an initial pass along a survey path 110, before or after the rig 10 has been secured in a stable and stationary position, followed by a subsequent pass along a scan path 120. In the survey path 110, sensor(s) 66 of liner application device 20 may be controlled to follow a pre-programmed, in some cases piecewise straight-line path, which is generally restricted to a central area of advance 100. Survey path 110 may be used in some cases for liner application device 20 to acquire positioning bearings within advance 100 in relation to one or more of side walls 102, 104 and/or top wall 106. Such bearing(s) may, when acquired, be defined in relation to an arbitrarily chosen reference origin within a suitable coordinate system. Because liner application device 20 may, upon entry into advance 100, not initially have ascertained its position relative to obstacles, such as side walls 102, 104 and top wall 106, survey path 100 may be effectively utilized by liner application device 20 to acquire bearings while staying a safe distance away from such obstacles. This may ensure that liner application device 20 does not thereby inadvertently strike into one of side walls 102, 104 or top wall 106, or any other obstacle or impediment.

Scan path 120 may be followed after the liner application device 20 has been located and physically stabilized with outrigger support arms (not shown) within advance 100 using the initial survey path 110. Accordingly, during one or more passes of scan path 120, sensor(s) 66 of liner application device 20 may sense locations of a number of different points on the three-dimensional surface profiles of side walls 102, 104 and top wall 106. Each location on a three-dimensional surface may be determined in three-dimensions using any suitable coordinate system for specifying relative or absolute position. For example, sensor(s) 66 of liner application device 20 may be used to detect the locations of such surface points as vectors defined in relation to the origin of whichever coordinate system is being utilized.

In some embodiments, the locations of surface points may be determined in part by estimating a vector (i.e., distance and angle) from sensor(s) 66 to such surface points. By continually tracking the position of sensor(s) 66 within the chosen coordinate system, locations for surface grid points on side walls 102, 104 and top wall 106 may then be determined as a vector sum of the distance from the sensor (s) 66 to the corresponding surface point(s) on side walls 102, 104 and top wall 106 combined with the known distance from the origin to the sensor(s) 66.

The scan path 130 may be defined so as to generally follow the surface contours of side walls 102, 104 and top wall 106 spaced apart a suitable distance or range therefrom (referred to herein sometimes as a "stand-off" or "back off" distance), as indicated in FIG. 3. In some cases, the stand-off distance to side walls 102, 104 and top wall 106 may lie within a range of distance selected so as to provide precise and accurate measurements, while still maintaining a safe distance from side walls 102, 104 and top wall 106 to reduce the likelihood of inadvertently striking such surfaces. The separation between sensor(s) 66 and side walls 102, 104 and top wall 106 while following the scan path 130 may be relatively or approximately constant in some cases, although this is not necessary.

In some embodiments, the scan path 130 may be determined based on a plurality of different landmark reference points 115 located on the surface contours of side walls 102, 104 and top wall 106. Based upon such landmark reference points, it may be possible to ascertain the general topography of side walls 102, 104 and top wall 106 with at least sufficient detail so as to define a suitable scan path 130. Accordingly, in at least some cases, a scan path 130 may be determined based on the plurality of landmark reference points 115 to provide close proximity to side walls 102, 104 and top wall 106 for precise and accurate scanning, but without inadvertently contacting any surfaces that could damage one or more components of liner application device 20 or that cause measurement error, such as by introducing instrument drift or displacement.

The one or more different landmark reference points 115 may have been determined by sensor(s) 66 during the initial pass along survey path 110, at the same time as liner application device 20 was attempting to ascertain its position within advance 100. The reference landmark points 115 may in some cases include points of local maximum height, i.e., points on the three-dimensional surface profiles of side walls 102, 104 and top wall 106 that project inwardly into the interior space of advance 100 further than all or most other points in an immediate vicinity. Such points of local maximum height may thereby be determined by identifying points on side walls 102, 104 and top wall 106 that are closer to sensor(s) 66 than all or most other points in the immediate vicinity. Seventeen different landmark reference points 115 are shown in FIG. 3, for convenience, although the number of points utilized may be larger or smaller depending on accuracy or other requirements.

In addition to points of local maximum height, reference landmark points 115 may further include a number of base points located at or near to the foot of each side wall 102, 104. Because advance 100 may be blasted or excavated, the floor 108 of advance 100 may not be entirely even and instead may also exhibit surface irregularities (e.g., as shown in FIGS. 4A-4D). So that liner application device 20 may also ascertain the profile of each transition from side wall 102, 104 to floor 108, and therefore estimate where each side wall 102, 104 terminates, one or more base points may also be determined. As explained further below, the number and density of such base points is variable depending on a desired spray resolution and, in some embodiments, may be used further in defining a spray path 130 for liner application device 20.

Spray path 130 for liner application device 20 may closely track the surface contours of side walls 102, 104 and top wall 106 and, in some cases, may be determined based on the representative topographical profile determined for such surface contours. Spray path 130 may define a general trajectory along which spray applicator(s) 66 may follow during, and so as to control, application of a liner material to a contoured surface. Although spray path 130 is shown in FIG. 3 being closer to side walls 102, 104 and top wall 106 than scan path 120, in some embodiments, spray path 130 and scan path 120 may approximately overlie one another.

In some embodiments, so as to control the thickness of an applied layer of TSL material, the spray path 130 may be determined maintaining an offset relationship with side walls 102, 104 and top wall 106. For example, as explained in more detail below, the efficacy of material mixing in a composite TSL material may depend on a number of different factors, such as a spray distance of the TSL material, i.e., the distance between the origin of the spray (e.g., spray nozzle(s) included in spray applicator(s) 62) and the surface being coated. Accordingly, spray path 130 may be determined so as to maintain, to the extent possible, a constant, and in some cases pre-specified, stand-off distance from the contoured surface. Maintaining a relatively constant stand-off distance may also generally contribute to the overall precision and accuracy of material coating, e.g., layer thickness.

As noted previously, being excavated through blasting or other explosive techniques, side walls 102, 104 and top wall 106 usually present very uneven surfaces or discontinuities. In some cases, side walls 102, 104 and/or top wall 106 may define a cavity or other recess, such as recess 135 in FIG. 3, which is not navigable by a liner application device 20. While spray path 130 may generally maintain a constant stand-off distance from side walls 102, 104 and top wall 106, straight line approximations may be used on occasion to bypass un-navigable recesses 135. Such recess(es) 135 may further be filled, wholly or partially, with an under layer of foam or other material, as explained further below.

The spray path 130 may further be determined in relation to side walls 102, 104 and top wall 106 so as to fall within a spray range of a liner application device 20. Limits on the spray range may be imposed by the nature of the liner material being sprayed. For example, it may be necessary to maintain a minimum distance to a contoured surface, such as side walls 102, 104 and/or top wall 106, in order to provide the constituent elements of the liner material with sufficient time to mix in the air before impacting on the rock surface. However, too great a distance may result in premature curing of liner material before deposition onto the contoured rock surface, which can be undesirable in some cases. Accordingly, the spray range should be selected to be within such upper and lower limits, if applicable. In some cases, a spray range of between 50-90 centimeters (cm) may be appropriate. For example, a spray distance of about 60-80 cm (or 24-32 inches) may be appropriate. The relatively narrow range of distance between minimum (for mixing of sprayed components) and maximum (to avoid premature curing), for example a range of 8 inches, is very difficult if not impossible for a human operator to consistently maintain using manual spraying equipment in a mine environment. Robotic scanning and spraying equipment can maintain an accurate spray distance within this narrow range.

Within the spray range of the liner application device 20, the thickness of the applied layer may be controlled as a function at least of the boom speed of the liner application device 20 relative to the contoured surface. For a given distance to a contoured surface, a greater boom speed tends to reduce the thickness of an applied layer of liner material, while a slower boom speed tends to increase layer thickness. For a given boom speed, back-off distance may also in some cases affect material thickness, although boom speed may have a predominant or overriding influence. In some cases, and for certain types of TSL materials, a layer thickness of between 3-6 mm may be appropriate, e.g., by providing sufficient tensile strength as to comply with one or more applicable standards or regulations. In such cases, a boom speed of about 400 mm/sec, or some other value in that general range, may be appropriate.

In some embodiments, spray path 130 may be computed on-the-fly, or essentially on-the-fly, during one or more passes of the scan path 120. As described further below, computation of spray path 130 may involve on-the-fly computations of control vectors for arm 22 that correspond to both position and orientation components of the spray path. Thus, the spray path 130 may be computed so that a trajectory for liner application device 20 is determined so an arm 22 of liner application device 22 is controlled to move from position to point along spray path 130 at each given position also with a corresponding approach, i.e., an angle relative to a contoured surface. As explained in more detail below with reference to FIGS. 4A-4D, different spray angles for a liner material may be effectively utilized. On-the-fly computation of control vectors for arm 22 may decrease downtime associated with provisioning ground support and therefore increase overall efficiency.

On-the-fly computation of control vectors for arm 22 may provide one or more advantages compared to approaches that are based on a priori three-dimensional mapping of a contoured surface (sometimes referred to as "point cloud"). Because in the point cloud approach, points on the contoured surface may be located prior to and without regard to orientation (e.g., of a liner application device), operational limitations of a robotic control, such as arm 22, may not initially considered. Thus, when control vectors for an arm 22 are being computed, unexpected behaviour of arm 22 may be observed due to unpredicted operational limits having been reached. However, by computing control vectors on-the-fly at the time of scanning, it may be easier to detect and then compensate for such operational limits.

Computation of control vectors for arm 22 may also, in some case, involve detecting that a given axis or degree of freedom has reached a physical limit and that, consequently, no further movement along that corresponding axis is possible. When it is detected that an axis has reached a physical limit, a coordinate of that axis may be reset to a default value or otherwise backed off its operational limit so that a new control vector for arm 22 may be computed in which further movement within the once-limited range is possible again. How the control vector is determined may depend on the type of movement possible in the range-limited part, e.g., plane movement or rotation/torsion.

For example, upper arm 30 and swivel joint 36 (FIG. 2) may each be capable of torsional or rotational movement. If it is detected that one of upper arm 30 and swivel joint 36 will reach an operational limit, e.g., 360 degrees of rotation, at some point in time while following along spray path 130, the associated control coordinate for either or both part of arm 22 may be reset to 0 degrees so that further rotation in the same direction is possible. During an actual pass of spray path 130, the effect of resetting the control coordinate would be to physically untwist lower upper arm 30 or swivel joint 36, depending on which component reaches its operational limit, e.g., by one full rotation once the operational limit had been reached to permit continued movement. This will prevent undesirable twisting of supply hoses for example. Predictive computation of control coordinates may be performed for each axis or degree of freedom in liner application device 20.

In some cases, operational limit(s) reached by one or more components in arm 22 may be handled also by adjustment to one or more non-limited components. For example, it may be possible to determine a new segment of spray path 130 when an operational limit is reached, at least in part, by backing the limited component off from its maximum (or minimum) and adjusting coordinates of additional component(s) in such manner that the desired position and orientation of arm 22 is recreated using an equivalent control vector to the one initially prevented from being computed due to component limiting. For example, if swivel joint 36 reaches an operational limit, it may be possible to recompute coordinates for base joint 36 and/or elbow joint 32 to provide equivalent trajectory of arm 22.

Referring now to FIGS. 4A-4D, in some embodiments, multiple different passes of a spray path 130 may be undertaken so as to provide a contiguous, constant thickness coating of TSL material to a contoured surface, such as side wall 102 of advance 100. Each of FIGS. 4A-4D illustrates one example pass that may be undertaken in combination with any or each other example pass illustrated. While four different passes are illustrated, in various embodiments, a greater or fewer number of passes may be undertaken depending on use and/or application. Moreover, FIGS. 4A-4D illustrate side wall 102 for convenience only, and could equivalently refer to side wall 104 or to top wall 106.

Because advance 100 may be formed through blasting or other explosive techniques, side wall 102 (also side wall 104 and top wall 106) may have rough or uneven surface contours that include different nooks, crevasses or other types of recesses formed thereon and that further has a rough or uneven transition to floor 108. Accordingly, TSL material may be sprayed onto the same point or area on such uneven surface contours from multiple different directions or angles.

As compared to single pass spraying, use of multiple spray passes and spray angles may result in more complete penetration of TSL material into such nooks, crevasses and/or recesses and thereby achieve an overall more contiguous coating of TSL.

Figure 4A:
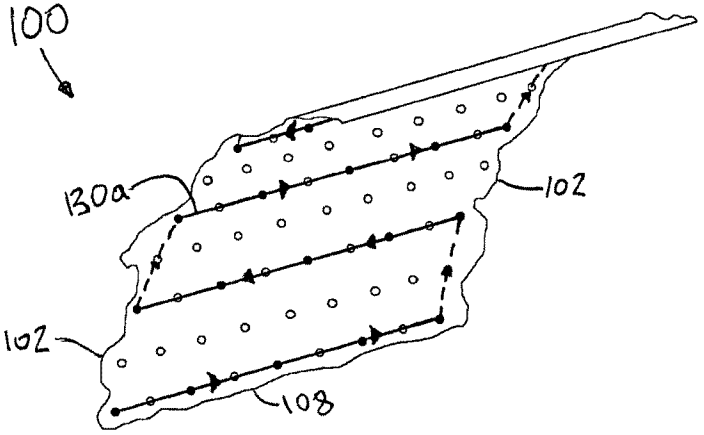
FIGS. 4A-4D illustrates spray paths for a segment of an excavated tunnel surface shown in perspective view.

In FIG. 4A, a first leg 130*a* of spray path 130 follows a first trajectory along side wall 102 (and which may extend continuously into top wall 106 and opposite side wall 104). According to the first leg 130*a*, each point on side wall 102 is sprayed with liner material while a liner application device (e.g., liner application device 20) is moving with a certain, although not necessarily consistent, trajectory. Some rows on side wall 102 are sprayed while the liner application device 20 is being controlled to move from left-to-right, while other rows on side wall 102 are sprayed while liner application device is being controlled to move from right to left. In this way, the entirety of advance 100 divided up into rows may be sprayed with a first material layer.

Figure 4B:
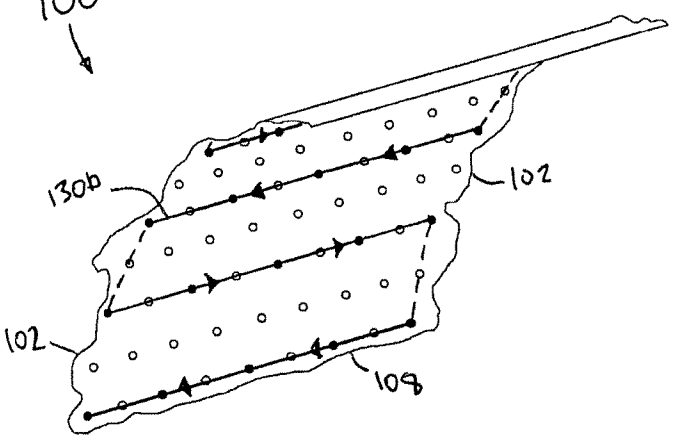

In FIG. 4B, a second leg 130*b* of spray path 130 follows a trajectory along side wall 102 that results in advance 100 being sprayed with a second layer of liner material following a side-to-side spray trajectory. However, each row on side wall 102 is sprayed in second leg 130*b* with a spray trajectory that is opposite to the spray trajectory used for that row in first leg 130*a*. Accordingly, rows on side wall 102 that are sprayed in first leg 130*a* with a left-to-right trajectory are now sprayed in second leg 130*b* with a right-to-left trajectory, and vice versa for rows sprayed in the first leg 130*a* with a right-to-left trajectory.

To increase the number of different spray trajectories or angles applied to each point on side wall 102, a further two passes of spray path 130 may be utilized, as in the illustrated embodiment. Whereas legs 130*a* and 130*b* divide up advance 100 into a number of different rows for spraying, additional layers of material may be applied by further dividing up advance 100 into a number of different columns. In either case, the number of different rows and columns may be varied deepening on a desired spray resolution. For finer resolution, a greater density of rows and/or columns may be utilized. In some cases, the row and column density may be approximately equal, although this is not a requirement.

Figure 4C:
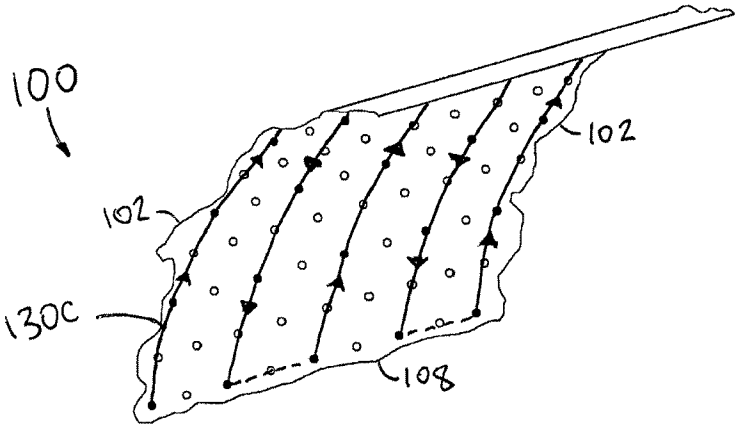

For example, in FIG. 4C, a third leg 130*c* of spray path 130 follows a third trajectory by dividing side wall 102 up into columns. Thus, some columns on side wall 102 are sprayed in third leg 130*c* while the liner application device 20 is being controlled to move from top-to-bottom, while other columns on side wall 102 are sprayed while liner application device 20 is being controlled to move from bottom-to-top. In this manner, each point on side wall 102 may generally be sprayed with liner material from a third trajectory different from that utilized in either first leg 130*a* or second leg 130*b*.

Figure 4D:
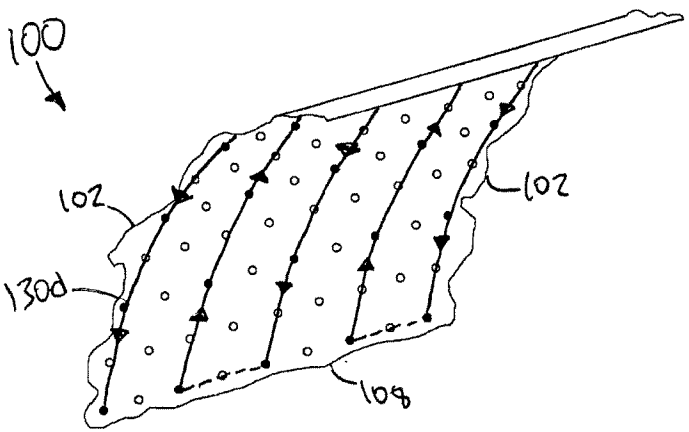

Similarly in FIG. 4D, a fourth leg 130*d* of spray path 130 follows a trajectory that results in side wall 102 being sprayed according to different columns exhibiting an up-and-down spray trajectory. Again, each column on side wall 102 is sprayed in fourth leg 130*d* with a spray trajectory that is opposite to the spray trajectory used for that column in third leg 130*c*. Columns on side wall 102 that are sprayed in third leg 130*c* with a top-to-bottom trajectory are now sprayed in fourth leg 130*d* with a bottom-to-top trajectory, and vice versa for column sprayed in the third leg 130*c* with a bottom-to-top trajectory.

In the aggregate, spray paths 130*a-d* may result in each point on side wall 102 (also side wall 104 and top wall 106) being sprayed with liner material originating from four different spray trajectories, i.e., left-to-right, top-to-bottom, right-to-left, and bottom-to-top. In each case, the angle of the spray trajectory relative to the contoured surface being sprayed, i.e., side wall 102, may be configurable depending on context or use. However, in some cases, a spray angle equal to or about 30-degrees may be appropriate, although other spray angles may be suitable as well in variant embodiments.

In some embodiments, spray path 130 may be determined by detecting both surface grid and intermediate points on a contoured surface. As used throughout the disclosure, "surface grid points" may refer to points on a contoured surface that are used directly to determine the trajectory of the spray path 130. On the other hand, "intermediate points" may refer to additional points on a contoured surface, other than surface grid points, which may be used to resolve possible measurement and/or instrumentation errors during detection of surface grid points. Surface grid points are shown in solid black in FIGS. 4A-4D, while example intermediate points are shown in white outline.

On a rough or uneven surface, such as side wall 102, one or more formations may be present that cause a potentially very sudden deviation in three-dimensional surface profile of the contoured surface. For example, a very sudden projection, such as a spire or a finger, may be formed in side wall 102. Additionally, in some cases, a very sudden recess or fissure may be formed. When scanning a contoured surface and one of the plurality of surface grid points used to generate a representative topographical profile happens to coincide with one of these surface formations, the measurement may deviate from levels set by adjacent or neighbouring measurements and therefore appear, without further information, as possible instrumentation or measurement error. So as to properly detect these such formations in side wall 102, it may sometimes be necessary to eliminate the possibility of instrumentation or measurement error and thereby verify the accuracy of each surface grid point that is determined.

Accordingly, in some embodiments, when a surface grid point detected on side wall 102 deviates from adjacent or neighbouring surface grid points by more than a preset amount, one or more intermediate points on side wall 102, interspersed among the surface grid points, may additionally be detected. The potentially erroneous surface grid point may be evaluated against the additionally detected intermediate points in order to form a determination as to its measurement accuracy. If the additionally detected intermediate points are consistent with a sudden formation in side wall 102, then the potentially erroneous surface grid point may be accepted as genuine; otherwise the potentially erroneous surface grid point may be discarded and/or re-measured.

As noted previously, in some embodiments, an advance 100 may be divided up in to a number of different columns and/or rows and sprayed with liner material on a per-row and per-column basis using leading spray angles. For example, FIGS. 4A and 4B show portions of four different rows, while FIGS. 4C and 4D show portions of six different columns, although these numbers are exemplary only. When spraying liner material on a per-column and per-row basis, to ensure continuity between adjacent columns and rows and, therefore, an overall contiguous coating of liner material, some measure of overlap between adjacent rows and columns may be provided. Surface grid points may therefore also be utilized to mark boundaries between adjacent columns and/or rows for affecting overlap. Ascertaining boundary points between adjacent columns or rows may allow for a spray of liner material onto one column or row to overlap with an adjacent column or row and vice versa by a sufficient or pre-determined amount so as to ensure continuity. As an example, columns of between about 10-40 cm, or more particularly 20-30 cm, with a 50% overlap may be suitable in some cases to provide adequate continuity, although other column sizes and percentage overlaps may be suitable as well in alternative embodiments. Similar widths and corresponding percentage overlaps may also be utilized for any rows defined in spray path 130.

Figure 5:
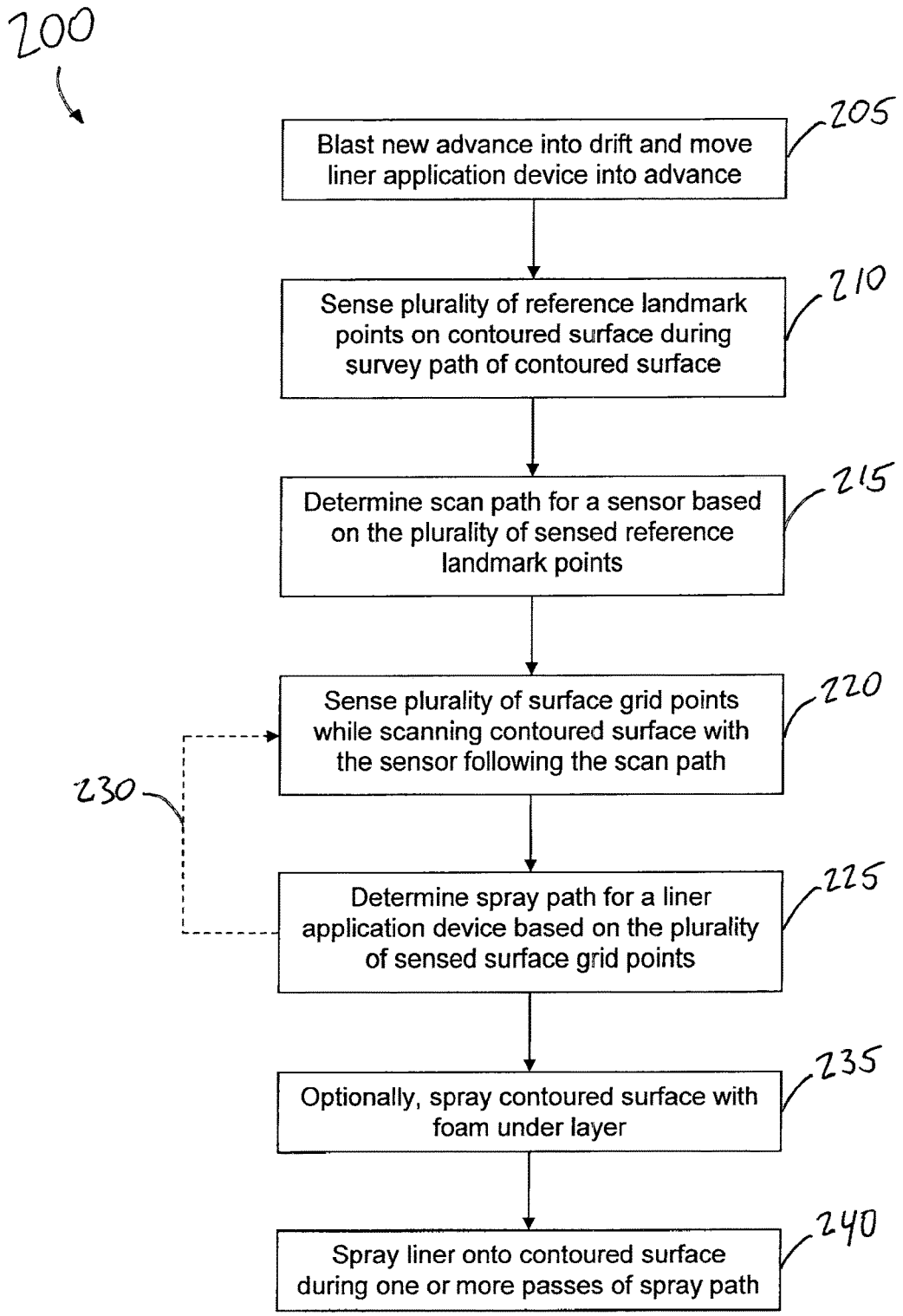
FIG. 5 illustrates a process flow for a method of applying a thin spray-on liner material to a contoured surface.

Referring now to FIG. 5, there is illustrated, in a flow chart, a method 200 of applying liner material(s) to a contoured surface. For example, the contoured surface may be an exposed rock face in a drift or advance excavated in an underground hard rock mine and the liner material(s) may include a thin spray-on liner (TSL) material and in some cases a foam primer. Method 200 may be performed, either wholly or in part, by a suitably configured liner application device, such as liner application device 20 shown in FIG. 1. Accordingly, description of method 200 may be abbreviated for clarity and further details may be found above with reference to any preceding figure.

At step 205, a new advance such as advance 100 in FIG. 3 may be blasted or otherwise excavated within an underground hard rock mine. Some time after blasting and other intermediate action (such as water scaling) is taken, a liner application device such as liner application device 20 in FIG. 1 may be maneuvered into a suitable position within an advance, which may be a generally central position within the advance. Once positioned the liner application device may be secured through any suitable restraints or support features provided with the liner application device. This way the position of a liner application device within an advance may be ascertained with reference to a suitable reference coordinate.

At step 210, a plurality of reference landmark points on the contoured surface may be detected, for example, by suitably configured sensor(s) following a survey path 110 defined in relation to the contoured surface. The sensor may be an optical sensor such as a laser or the like. In some embodiments, the reference landmark points may include local maxima, i.e., points of local maximum elevation on the contoured surface. However, the reference landmark points may also include a number of base points located at the foot of the contoured surface. In this case, each base point may be located at the foot of a corresponding column into which the contoured surface has been divided.

At step 215, a scan path may be computed based on the previously determined reference landmark points. The scan path may define a trajectory in relation to the contoured surface and along which the sensor(s) may be followed so as to determine a more comprehensive topographical profile of the contoured surface. The scan path may generally follow along the contoured surface offset by some distance, which may be predetermined, but this is not necessarily the case. Reference landmark points determined in step 205 may be used to ensure no inadvertent content with the contoured surface during scanning. Base points at the foot of the contoured surface may in particular be used to ensure complete coverage of the contoured surface without inadvertently contacting the floor into which the contoured surface transitions.

At step 220, the sensor(s) may be controlled to follow the previously determined scan path along one or more passes, as required, such that a representative topographical profile of the contoured surface is generated. In some cases, such a representative topographical profile may be defined by a plurality of surface grids that were detected on the contoured surface while following the scan path. The number and density of detected surface grid points is variable in different embodiments, but may generally be sufficient in order to provide a sufficiently accurate topographical profile.

At step 225, a spray path for a liner application device may be determined based on the detected plurality of surface grid points, in some cases, in conjunction with one or more intermediate points used to resolve measurement ambiguities. The spray path may define a trajectory for spray applicator(s) to follow along offset from the contoured surface by a stand-off distance, which may be pre-determined in some cases. The spray path may be defined according to a sequence of control vectors for a liner application device, which specify both positional and orientational components. Thus, the determined spray path may generally indicate both points in three-dimensional space through which the liner application device is to be controlled, as well as respective orientations for the liner application device at each particular point in space.

Loop 230 in FIG. 5 indicates that steps 220 and 225 may be performed repeatedly and alternately in a loop so that a spray path may be determined segment-by-segment in real or near real-time (i.e., on the fly) as surface grid points are being detected. Accordingly, by not having to complete a scan of an advance before a spray path is determined, in some cases considerable time savings may be realized, which in mining operations may have significant cost implications. Further details of steps 220 and 225 are explained below with reference to FIGS. 6 and 7, respectively.

At step 235, after having computed a spray path through one or more iterations of steps 220 and 225, a contoured surface may be coated with a base or under layer, which may be a foam primer in some embodiments. For example, coating the contoured surface with a foam under layer may be useful to wholly or partially fill crevasses and other difficult to navigate (e.g., due to small size) recesses that are present in contoured surface. Application of a hydrophilic foam primer may also effectively provide a dry surface for subsequent application of a TSL material. In some cases, a two-part foam material may be utilized. Step 235 may be optional and omitted in some embodiments.

At step 240, the contoured surface may be sprayed with liner material while controlling the liner application device to follow the previously determined spray path. One or more passes of the spray path may be undertaken depending on how the spray path has been defined. For example, the spray path may comprise multiple different legs or segments, e.g., 4 segments, each of which corresponding to a different pass along the contoured surface with a leading spray angle for liner application device. In such cases, each segment of the spray path may be followed with the liner application device at least once.

Following step 240, at which point the entire contoured surface may be coated with liner material and optional foam under lay, the liner application device may be removed for further excavation into a mine shaft or tunnel of an underground hard rock mine.

As illustrated in FIG. 5, it is assumed that the entire contoured surface is mapped (e.g., using iterations steps 220 and 225) before any liner material is sprayed. Accordingly, branch 230 is defined between steps 220 and 225. However, in alternative embodiments, surface contour mapping and spraying may be alternated, in which case only a section of contoured surface may be sprayed with liner material after that portion has been surface mapped, but prior to a next portion of the contoured surface being mapped and sprayed. Each such embodiment, as well as others still, is possible.

Figure 6:
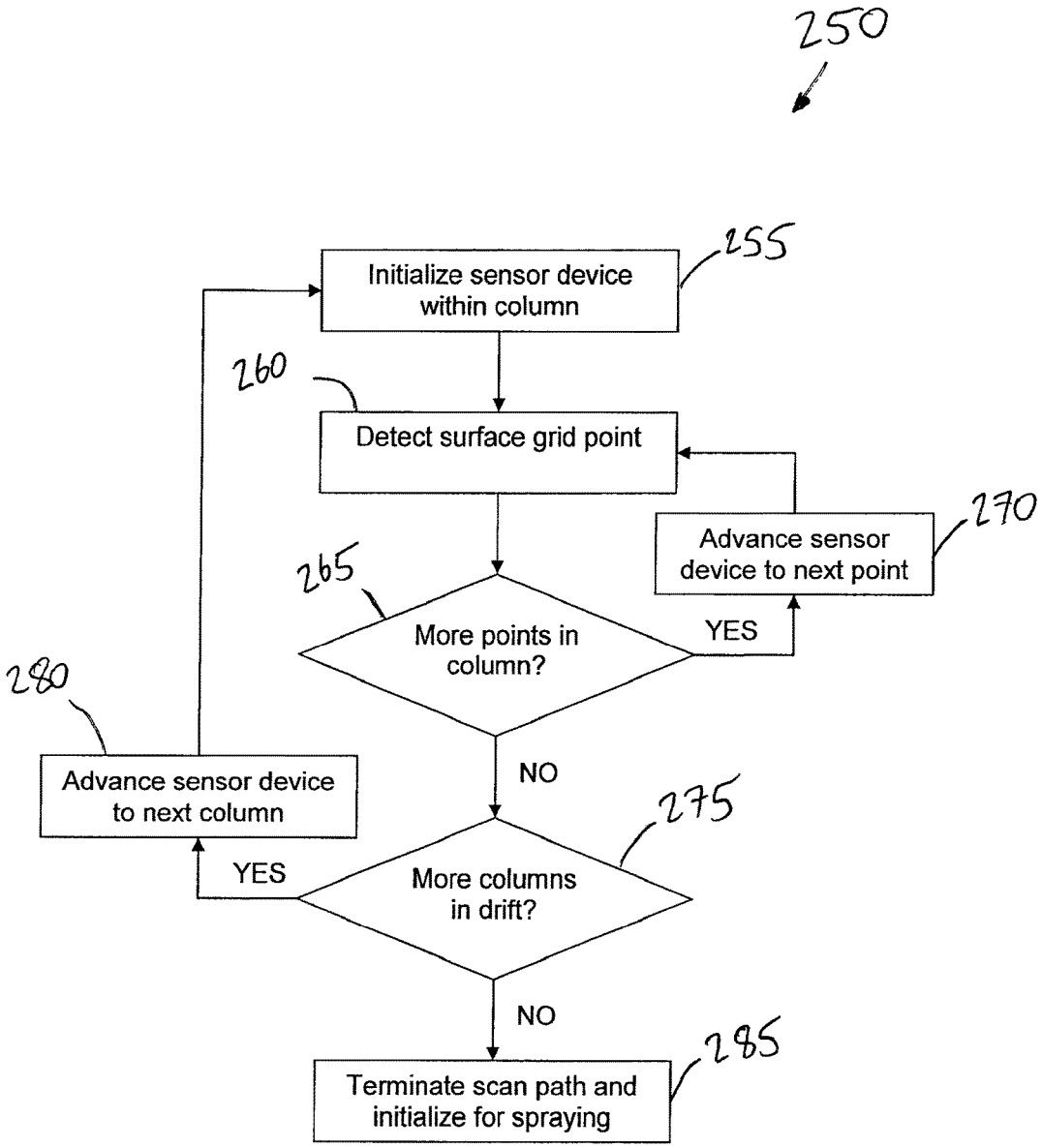
FIG. 6 illustrates a process flow for a method of detecting surface grid points on a contoured surface.

Referring now to FIG. 6, there is illustrated, in a flow chart, a method 250 of detecting surface grid points on a contoured surface. For example, method 250 may be employed in some cases as part of or in conjunction with step 220 of method 200 shown in FIG. 5. (As step 220 may be performed repeatedly and alternately with step 225, it will be understood that the steps illustrated in FIG. 6 are not necessarily performed each iteration of step 220 and instead may represent the overall result of repeated performance of step 220 as part of method 200). Accordingly, description of method 250 may be abbreviated for clarity and further details may be found above with reference to FIG. 5.

Embodiments of method 250 may be useful for detecting surface grid points on a contoured surface by dividing up the contoured surface into a plurality of columns and scanning on a per-column basis until the entire contoured surface is scanned. The number of columns is variable and may depend on a desired scanning resolution, with a greater number of columns equating to finer resolution. To assist with division into columns, a number of base points may be pre-determined with each such base point marking the foot of a corresponding column.

In step 255, a sensor device is initialized within a column, for example, but not necessarily, at the base point detected for the given column.

In step 260, a surface grid point is detected at the location on the contoured surface to which the sensor device is generally oriented.

In step 265, it is checked whether there are additional points in the column to be scanned. For example, this determination may be made by checking whether the sensor device has been advanced to a previously determined terminal point in the column, which may be a base point or may be a point located at an opposite end of the column to the base point. If it is determined that additional points in the column remain to be detected, method 250 may branch to step 270 wherein the sensor device is advanced to a next point to be detected. Following advancement of the sensor device, method 200 may return to step 260 for detection of a new surface grid point.

However, it is determined in step 265 that the end of the column has been reached, then it is determined in step 275 whether there are additional columns within the drift advance to be scanned. Similar to step 265, this determination may be made using previously determined points on the contoured surface, such as base points or other terminal points that may indicate additional columns to be scanned. If it determined that additional columns are to be scanned, method 250 branches to step 280 wherein the sensor device is advanced to the next column. After advancement of the sensor device, method 250 returns to step 255 for initialization of the sensor device within the column, if necessary. For example, this may involve re-acquiring a previously determined base point in the column into which the sensor device has been advanced. Otherwise if it is determined in step 275 that no further columns remain, then method 250 may terminate in step 285 with the scan path fully determined. Preparation for spraying the contoured surface may then commence.

Using an "inner loop" formed by the branch which includes step 270 and an "outer loop" formed by the branch which includes step 280, the entire contoured surface may be scanned point-by-point on a per-column basis. However, this is only one example order that may be followed and in various embodiment the order of scanning may be varied. For example, as noted below, in some cases additional intermediate grid points may be determined for such reasons as error-checking. In this case, deviations to the order presented in FIG. 6 may be permissible.

Figure 7:
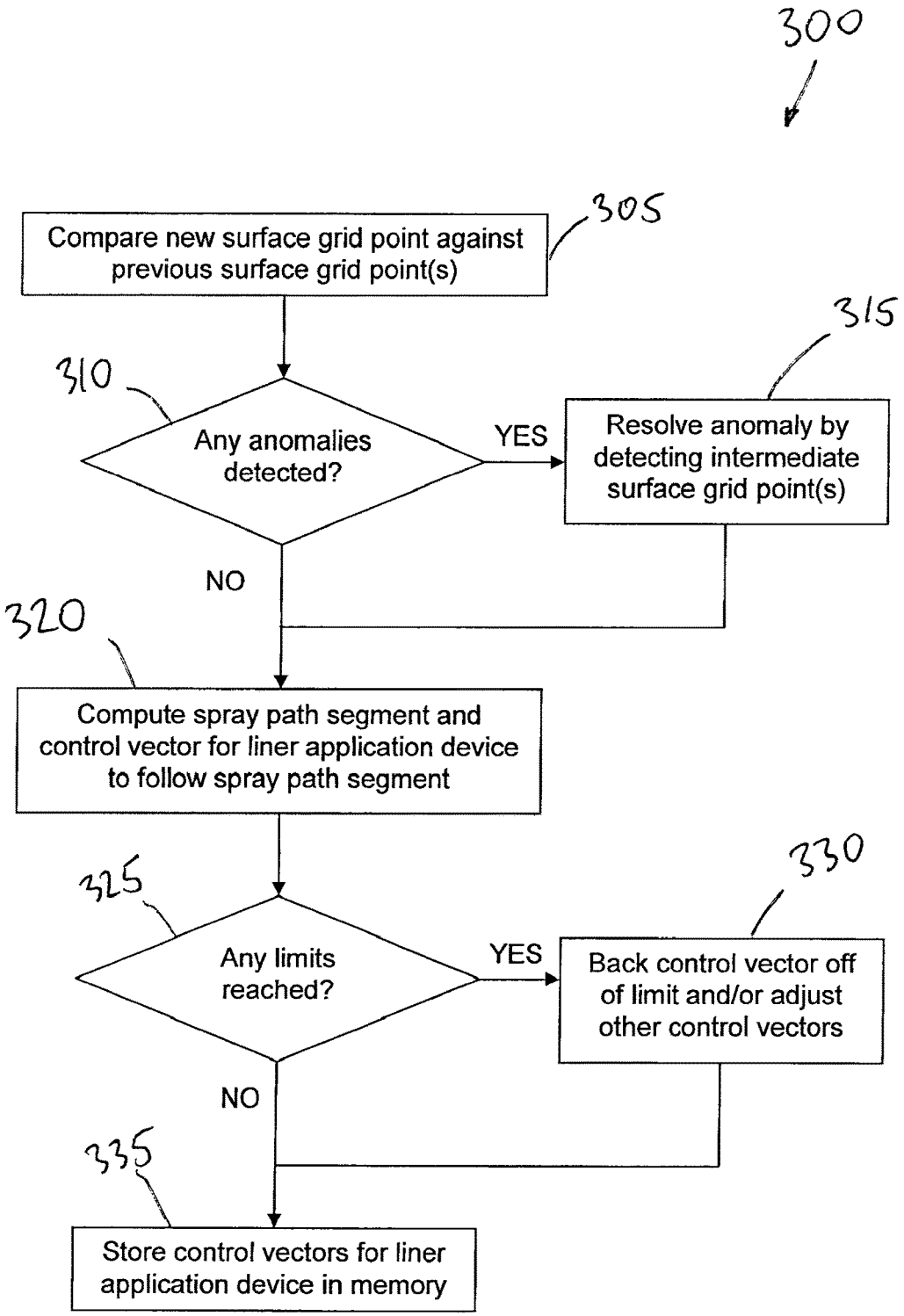
FIG. 7 illustrates a process flow for a method of determining a spray path for application of a thin spray-on liner material.

Referring now to FIG. 7, there is illustrated, in a flow chart, a method 300 of determining a spray path for a liner application device. For example, method 300 may be employed in some cases as part of or in conjunction with step 225 of method 200 shown in FIG. 5. (As step 225 may be performed repeatedly and alternately with step 220, it will be understood that the steps illustrated in FIG. 7 are not necessarily performed each iteration of step 225 and instead may represent the overall result of repeated performance of step 225 as part of method 200). Accordingly, description of method 300 may be abbreviated for clarity and further details may be found above with reference to FIG. 5.

At step 305, a newly detected surface grid point may be compared against one or more previously detected surface grid points. For example, each newly detected surface grid point may be compared against one or more neighbouring surface grid points, either in the same column as the newly detected point or in adjacent columns, if any have been detected. Generally, as the scan path may follow along the contoured surface in a linear fashion, at least one neighbouring surface grid point may already have been detected, i.e., the previously detected surface grid point in the same column. Additional neighbouring points may also be available from neighbouring columns starting with the second column scanned.

At step 310, it is determined whether any anomalies in the surface grid points have been detected. Anomalies may correspond to erroneous measurements and/or detection errors that appear as a particular surface grid point being far out of line with its neighbours and therefore possibly erroneous. If it is determined at step 310 that anomalous measurements have been detected, method 300 may branch to step 315 wherein one or more intermediate surface grid points on the contoured surface are additionally detected. Based on the additionally detected intermediate surface grid points, it may be determined whether the surface grids are accurate or were, in fact, erroneous. In the latter case, new surface grid points may optionally be detected and the method branches to step 320. Otherwise if no anomalous surface grid points were identified in step 310, method 300 may branch directly to step 320 bypassing step 315.

At step 320, an incremental segment of a spray path may be computed based on the previously detected surface grid points. The incremental segment may reflect control coordinates for a liner application device to move from a previous position in relation to the contoured surface to a new position, e.g., which may be determined based on the newly detected (and in some cases validated) surface grid points. Accordingly, a new control vector for liner application device that will move from such previous position to the new position may be computed.

At 325, it is determined whether the newly computed control vector will cause the liner application device to reach any operational limits. For example, the liner application device may be capable of two or more different degrees of freedom, each of which corresponding to movement within a range along a different axis. If it is determined that any axis has reached a limit on its range of movement, method 300 may branch to step 330, wherein a new control vector for liner application device may be computed in which one or more control coordinates have been backed off operational limits and/or reset to baseline values. After computation of a new control vector, method 300 may advance to step 335.

Otherwise, if no range-limited axes are determined in step 325, method 300 may branch directly to step 335 bypassing step 330.

At step 335, the previously determined control vectors, which in the aggregate define a spray path for a liner application device, may be stored for later use. Thereby the control vectors may be accessed so as to control the liner application device to follow the spray path.

The process flows illustrated in FIGS. 5-7 are exemplary only and various modifications may be made to either or both in different embodiments. For example, in some cases, one or more of the illustrated steps may be performed in a different sequence than what is illustrated or, alternatively, not at all. In other case, one or more additional steps not explicitly illustrated may also be included. Additionally, certain of the steps illustrated may be shown as discrete elements, but such presentation is for convenience only and does not necessarily (unless context dictates otherwise) reflect a particular temporal or causal relationship between the illustrated elements. The particular presentations are merely illustrative.

The above description is meant to be exemplary only, and one skilled in the art will recognize that changes or variations may be made without departing from the scope of the embodiments disclosed herein. Still other modifications which fall within the scope of the described embodiments may be apparent to those skilled in the art, in light of a review of this disclosure, and such modifications are intended to fall within the appended claims.

The invention claimed is:

1. A method of applying a liner material to a contoured surface, using a liner application device having a multi-axis robotic arm with a head assembly, comprising a sensor and a spray applicator, wherein each of the sensor and spray applicator has an operational axis extending from a distal end thereof, the multi-axis robotic arm being controllable for movement with multiple degrees of freedom capable of disposing the distal end in a three dimensional position and capable of disposing the operational axis at an orientation angle, the spray applicator comprising a spray nozzle fluidly coupled to a reservoir of the liner material for emitting a spray of the liner material toward the contoured surface, the method comprising:

sensing locations of an initial plurality of surface points on the contoured surface, the initial plurality of surface points being spatially distributed so as to provide a representative initial topographical profile of the contoured surface, the locations of the initial plurality of surface points being sensed while scanning the contoured surface with the sensor along an initial scan path that generally follows the topographical profile of the contoured surface;

identifying an anomalous point from the initial plurality of surface points, wherein the anomalous point has an anomalous coordinate that deviates from an extrapolated coordinate that is extrapolated from coordinates of the initial plurality of surface points upstream or downstream from the anomalous point along the initial scan path;

scanning the contoured surface with the sensor along a secondary scan path that generally follows the topographical profile of the contoured surface to sense at least one intermediate point on the contoured surface between the anomalous point and the initial plurality of surface points upstream or downstream from the anomalous point along the initial scan path, extrapolating from the at least one intermediate point to determine whether the anomalous coordinate constitutes an initial scanning error or whether the anomalous coordinate has identified a discontinuity in the contoured surface at the anomalous point;

when the anomalous coordinate is determined to be an initial scanning error, discarding the anomalous point from the initial plurality of surface points;

when the anomalous coordinate has identified the discontinuity in the contoured surface at the anomalous point, adding the at least one intermediate point to the initial plurality of surface points to produce a secondary plurality of surface points thereby providing a representative secondary topographical profile of the contoured surface;

based on the representative secondary topographical profile of the contoured surface, determining a spray path being a sequence of control vectors defining the movement of the multi-axis robotic arm and head assembly, the spray path comprising a trajectory of three dimensional positions of the distal end and orientation angle of the operational axis that follows the representative secondary topographical profile of the contoured surface offset therefrom within a spray range of the liner application device; and spraying the contoured surface with the liner material while automatically controlling the liner application device to undertake at least one portion of the spray path.

2. The method of claim 1, further comprising while controlling the liner application device to follow the initial scan path and the secondary scan path, computing the sequence of control vectors for the spray path.

3. The method of claim 1, further comprising:

sensing locations of a plurality of reference landmark points on the contoured surface; and determining the initial scan path based on the plurality of reference landmark points.

4. The method of claim 3, wherein the initial scan path is determined so as to maintain a predetermined range of distance between the sensor and the contoured surface during scanning between 8 and 35 inches.

5. The method of claim 3, wherein the locations of the plurality of reference landmark points are sensed during a survey scan of the contoured surface performed by the sensor prior to the scanning.

6. The method of claim 3, wherein the plurality of reference landmark points comprise local maxima in the topographical profile of the contoured surface.

7. The method of claim 1, wherein the liner material is sprayed onto the contoured surface as a substantially constant-thickness surface layer.

8. The method of claim 1, wherein the liner material is sprayed onto the contoured surface in a plurality of passes of the liner application device along the spray path, during each of the plurality of passes liner material is sprayed onto the contoured surface with the operational axis of the spray applicator being at a different orientation angle relative to the spray path.

9. The method according to claim 8 wherein the plurality of passes comprises: an upward vertical pass; a downward vertical pass; a forward horizontal pass; and a reverse horizontal pass.

10. The method according to claim 9 wherein the operational axis of the spray applicator is directed to spray liner material at an orientation angle of 30 degrees relative to the direction of travel.

11. The method of claim 1, wherein the contoured surface comprises an exposed rock face, and wherein the liner material comprises liquid polymer.

12. The method of claim 11 wherein the liner material has a thickness in the range of 3 to 6 millimeters (about ⅛ to ¼ inches).

13. The method of claim 1 wherein the step of determining a spray path based on the plurality of surface points includes:

eliminating a singularity by selecting between at least two different sequences of control vectors for defining the movement of the multi-axis robotic arm and head assembly that result in an identical trajectory of three dimensional positions of the distal end and orientation angle of the operational axis relative to the spray path.

14. The method of claim 1 wherein the anomalous point is disposed on a transitional contoured surface selected from the group consisting of: a T-shaped tunnel junction; a Y-shaped tunnel junction; a transition area between a horizontal tunnel and a vertical shaft; a recessed safety bay; a recessed formation; and a protruding formation.

15. The method according to claim 14, wherein the spraying of the contoured surface with the liner material comprises spraying a hydrophilic base coat foam under layer in a primer pass to substantially fill said recessed formation; allowing the base coat to cure and then spraying a liquid polymer over the base coat in a finish pass.

16. The method according to claim 1 wherein the plurality of passes comprise a first pass having a first coverage area and a second pass having a second coverage area that is sprayed to overlap the first coverage area by about 50%.

17. A non-transitory computer-readable storage medium on which are stored instructions that, when executed by one or more data processors, program the one or more data processors to perform a method of applying liner material to a contoured surface using a liner application device having a multi-axis robotic arm with a head assembly, comprising a sensor; and a spray applicator, wherein each of the sensor and spray applicator has an operational axis extending from a distal end thereof, the multi-axis robotic arm being controllable for movement with multiple degrees of freedom capable of disposing the distal end in a three dimensional position and capable of disposing the operational axis at an orientation angle, the spray applicator comprising a spray nozzle fluidly coupled to a reservoir of the liner material for emitting a spray of the liner material toward the contoured surface, the method comprising:

sensing locations of an initial plurality of surface points on the contoured surface, the initial plurality of surface points being spatially distributed so as to provide a representative initial topographical profile of the contoured surface, the locations of the initial plurality of surface points being sensed while scanning the contoured surface with the sensor along an initial scan path that generally follows the topographical profile of the contoured surface;

identifying an anomalous point from the initial plurality of surface points, wherein the anomalous point has an anomalous coordinate that deviates from an extrapolated coordinate that is extrapolated from coordinates of the initial plurality of surface points upstream or downstream from the anomalous point on the initial scan path;

scanning the contoured surface with the sensor along a secondary scan path that generally follows the topographical profile of the contoured surface to sense at least one intermediate point on the contoured surface between the anomalous point and the initial plurality of surface points upstream or downstream from the anomalous point along the initial scan path, extrapolating from the at least one intermediate point to determine whether the anomalous coordinate constitutes an initial scanning error or whether the anomalous coordinate has identified a discontinuity in the contoured surface at the anomalous point;

when the anomalous coordinate is determined to be an initial scanning error, discarding the anomalous point from the initial plurality of surface points;

when the anomalous coordinate has identified the discontinuity in the contoured surface at the anomalous point, adding the at least one intermediate point to the initial plurality of surface points to produce a secondary plurality of surface points thereby providing a representative secondary topographical profile of the contoured surface;

based on the representative secondary topographical profile of the contoured surface, determining a spray path being a sequence of control vectors defining the movement of the multi-axis robotic arm and head assembly, the spray path comprising a trajectory of three dimensional positions of the distal end and orientation angle of the operational axis that follows the representative secondary topographical profile of the contoured surface offset therefrom within a spray range of the liner application device; and spraying the contoured surface with the liner material while automatically controlling the liner application device to undertake at least one portion of the spray path.

18. The method according to claim 1 wherein the spraying of the contoured surface with the liner material comprises spraying a hydrophilic base coat under layer in a primer pass; allowing the base coat to cure and then spraying a liquid polymer over the base coat in a finish pass.

* * * * *